US005177920A

United States Patent [19]

Rafeld

[11] Patent Number: 5,177,920

[45] Date of Patent: Jan. 12, 1993

[54] CROSS-CONNECTOR OF PLASTIC MATERIAL FOR A WINDOW GRILL CONSTRUCTION

[75] Inventor: Karl Rafeld, Biessenhofen-Ebenhofen, Fed. Rep. of Germany

[73] Assignee: Cera Handelsgesellschaft mbH, Biessenhofen-Ebenhofen, Fed. Rep. of Germany

[21] Appl. No.: 702,762

[22] Filed: May 17, 1991

[30] Foreign Application Priority Data

May 23, 1990 [DE] Fed. Rep. of Germany ..... 9005886

[51] Int. Cl.[5] ..... E06B 7/00

[52] U.S. Cl. ..... 52/314; 403/295; 403/278; 52/507; 52/456; 52/665

[58] Field of Search ..... 403/174, 178, 205, 291, 403/295, 298; 52/507, 314, 456, 664, 665

[56] References Cited

U.S. PATENT DOCUMENTS 4,105,348 8/1978 Anderson et al. ..... 403/295

4,714,370 12/1987 Chen ..... 403/295

4,895,548 1/1990 Holland et al. ..... 403/298

*Primary Examiner*—David A. Scherbel

*Assistant Examiner*—Wynn E. Wood

*Attorney, Agent, or Firm*—Kalish & Gilster

[57] ABSTRACT

The invention relates to a cross-connector of plastic material for hollow profiled window grill bars introduced into the insulating space of an insulated window assembly consisting of two panes. Such a cross-connector consists of four legs positioned perpendicularly to one another and being configured such that they be inserted into the ends of the hollow profiled window grill bars in order to become fixed with these bars which are fixed to the peripheral frame of the window at their other ends. The present invention achieves the advantages of increased flexure and torsional strengths, and lower weight, while using a plastic material containing break-throughs, or alternatively, recesses. In addition, angled pins positioned oblique to the direction of insertion of the cross-connector legs result in a tighter, more permanent connection.

10 Claims, 2 Drawing Sheets

CROSS-CONNECTOR OF PLASTIC MATERIAL FOR A WINDOW GRILL CONSTRUCTION

BACKGROUND OF THE INVENTION

The invention relates to a cross-connector of plastic material for hollow profiled window grill bars introduced into the insulating space of an insulated window assembly consisting of two panes.

Such a cross-connector consists of four rectangular legs positioned perpendicularly to one another and being configured such that they can be inserted into the ends of the hollow profiled window grill bars in order to become fixed with these bars which are fixed to the peripheral frame of the window on which the two panes are located. Between these panes, the insulated space is formed including the four crossing bars connected by the cross-connector.

Known cross-connectors of such a kind are provided with slotted fork-like legs adapted with respect to their configurations to be pushed under pressure into the hollow spaces of the bars. The rotational stiffness and flexure strength of these cross-connectors, however, are not satisfying. Moreover, despite spaces between the fork-like elements, they require a relatively great volume of material resulting in a design of relatively great weight.

SUMMARY OF THE PRESENT INVENTION

It is therefore an object of the invention to improve the cross-connector of the known kind with respect to its resistance against bending and torsional stresses.

It is a further object of the invention to reduce the weight of the cross-connector and to manufacture it of a less quantity of plastic material without effecting negatively its function so that they cross each other in the center point in order to avoid the above-mentioned drawbacks.

These and other objects of the invention are solved by a construction characterized in that the cross-connectors are configured as a skeleton body provided with numeruous breakthroughs or holes separated by a reinforcing construction consisting of parallel and perpendicular walls. These bars run into the outside wall of the legs which are partially provided on their outer surface with angled pins extending oblique to the direction of insertion of the legs into the hollow profiled bars.

The essential idea underlying the invention should therefore be seen therein to manufacture the cross-connector, not as a completely or nearly completely solid body, but as a skeleton-like body providing, because of its numerous breakthroughs or holes in its surface, the required reduction of material while, providing such a body with the required stiffness and strength so that it has an essentially improved resistance against bending and torsional stresses on comparing it with a solid body. This is because of the fact that the breakthroughs and holes or recesses are surrounded by rib-like bars supporting the outside walls of the cross-connector.

According to a favourable embodiment of the invention, the holes or recesses or breakthroughs in the surface of the body of the cross-connector are not only provided in its four rectangularly abutting legs but also in its core area from which these legs extend. Moreover, according to a further advantageous embodiment of the invention, each of the legs is provided with six breakthroughs or recesses adjacent in pairs to one another so that three of them are always located on both sides of the longitudinal axis of each leg.

In order to define clearly the position of the hollow profiled bars of the window grill with respect to the cross-connector, the four legs thereof are to be shifted into the bars of the window grill. According to a further embodiment, the cross-connector is provided with abutment elements adjacent to its care area on which the profiled bars abut perpendicularly with respect to one another. Because of these abutment elements, the profiled bars get a precisely defined seat on the cross-connector body.

According to a further embodiment, recesses are used in the surface of the cross-connector body instead of breakthroughs. The bottoms of the recesses form a reinforcing wall located in either the same or parallel level to the surface of the legs. In both cases recesses can be provided on both sides of these reinforcing walls having, however, possibly different depths.

DESCRIPTION OF THE DRAWINGS

A better understanding of the invention will be reached by reference to the following detailed description when read in conjunction with the accompanying drawings in which.

Figure 1:
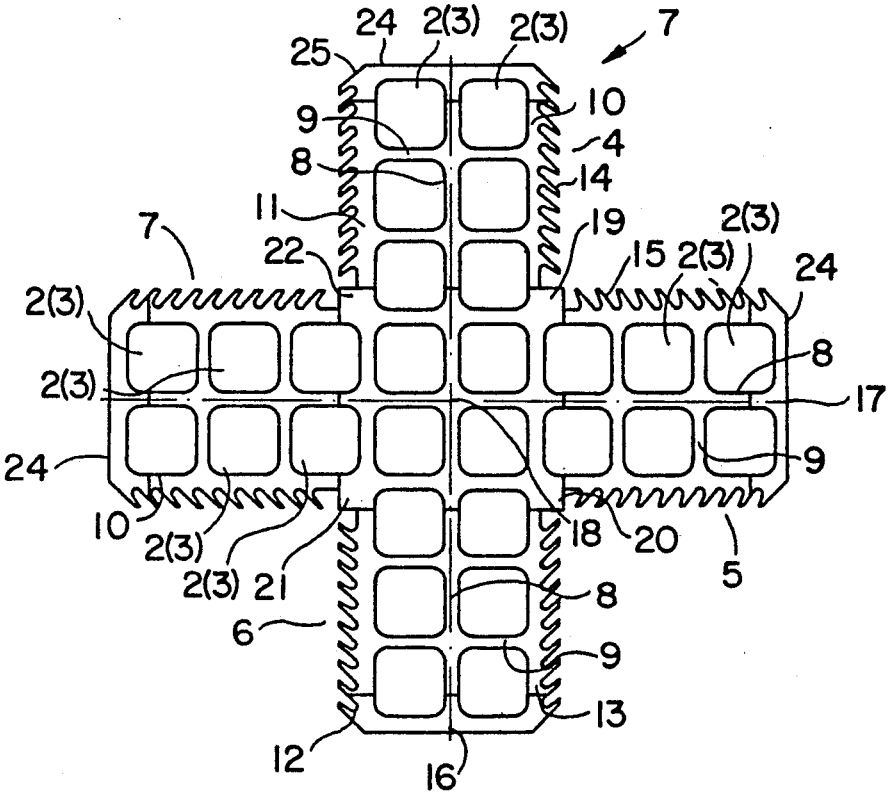
FIG. 1 is a plan view of an embodiment of the cross-connector alternatively provided with recesses or breakthroughs of a square contour.
Figure 2:
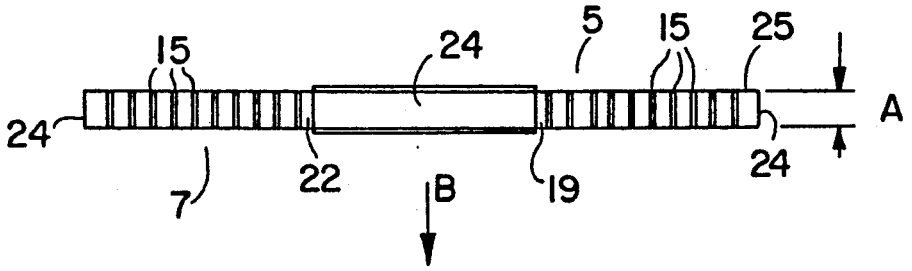
FIG. 2 is a front view of the cross-connector of FIG. 1 in direction of the arrow B.

A cross-connector 1 as shown by FIGS. 1 and 2, consists of hard plastic material and is provided with four legs 4, 5, 6, 7 which are offset from one another by an angle of 90°. These four legs extend from a core area 18 of cross connector 1 and are, as core area 18 itself, provided with several break-throughs 2 extending through the whole thickness A of the cross section of the connector body and form thereby a reinforcing structure of rods 8 extending parallel to leg longitudinal axes 16, 17 of these legs as well as of rods 9 extending perpendicular thereto. Such a cross-connector is characterized by a skeleton-like structure providing resistance against bending and torsional stresses, resulting however, in an essential reduction of material, and consequently in weight, in comparison with a common solid sectional profile.

The rods 8, 9 run into outside walls 10, 11 of legs 4, 5, 6, 7 which all together form a thin wall defining the skeleton body and being provided on its outer surfaces 12, 13 with angled pins 14, 15 positioned oblique to the direction of insertion of the legs into the hollow profiled bars (not shown) forming the window grill. Front faces 24 of legs 4, 5, 6, 7 have slanted edges 25 in order to assist shifting of the profiled bars onto the legs.

In the embodiment as shown by the drawings each of the four legs 4, 5, 6, 7 is provided with six breakthroughs 2 of the same configuration which are positioned in pairs adjacent to one another so that three of them are always located on both sides of the longitudinal axes 16, 17 of the legs 4, 5, 6, 7 and are located in the same level. At their inner ends, i.e., where legs 4, 5, 6, 7 extend into core area 18 of cross-connector 1, the legs are provided with abutment elements 19, 20, 21, 22 for abutting the window grill bars for a definite seat with respect to cross-connector 1. These abutment elements 19, 20, 21, 22 may extend around the periphery of the legs in order to close the opening of the hollow space of the profiled bars of the window grill.

The pins 14, 15 provided on the small side of the leg surface are relatively elastical elements and have the purpose to provide, between the inside wall of the hollow profiled bars and outer surface 12, 13 of cross-connector 1 an elastic connection which causes pins 14, 15 to deform, not plastically but only elastically, on moving the profiled bars onto legs 4, 5, 6, 7 so that a permanently fixed seat of the four window grill bars on cross-connector 1 is reached.

Figure 3:
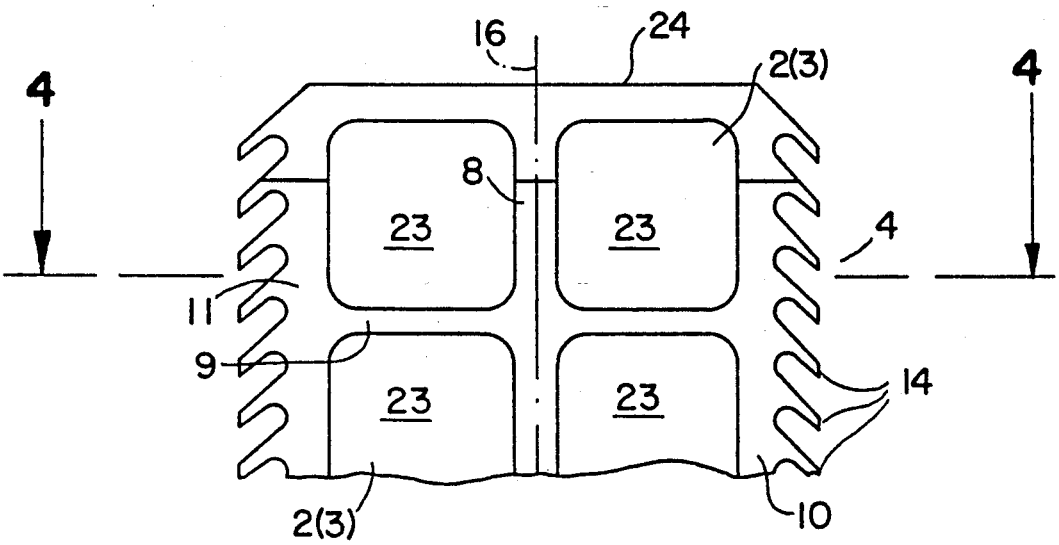
FIG. 3 is an enlarged partial view of one of the four legs of the cross-connector of FIG. 1 in accordance with another embodiment and FIG. 4 is a sectional view along the line 4—4 in FIG. 3.
Figure 4:
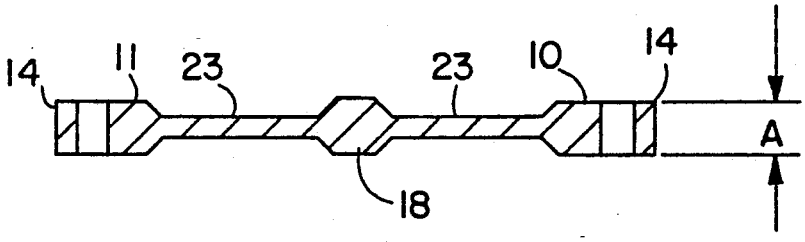

FIGS. 3 and 4 show another embodiment of cross-connector 1 where recesses 3 are provided in the surface of the legs 4, 5, 6, 7 as well as of the core area 18 of the connector instead of break-throughs 2. The bottoms thereof are defined by a reinforcing wall 23 positioned in the level of the legs. This reinforcing wall 23 is positioned in FIG. 4 in the central level dividing the cross sectional thickness A of cross-connector 1 into two halves which means that the depth of recesses 3 on both sides of that central level are identical. This feature, however, is not a necessary condition, as other embodiments are also suited in which this reinforcing wall is laterally offset with respect to the central level of the cross section of the legs.

What is claimed is:

1. A cross-connector of plastic material provided with four legs mutually positioned perpendicularly to each other for the use in connection with hollow profiled window grill bars extending mutually perpendicularly to one another, where said legs can be inserted into the ends of said crossing profiled bars in order to connect these profiled bars to each other, wherein the legs of the cross-connector are configured to form a skeleton body provided with numerous break-throughs, or alternatively recesses, separated from each other by an enforcing structure of rods extending parallel and perpendicular to the longitudinal axes of the legs, said rods running into the outside walls of the legs forming thin wall members of the skeleton body where said wall members are provided on their outside surfaces, at least partially, with angled pins positioned oblique to the direction of insertion of the legs into the hollow profiled bars.

2. Cross-connector according to claim 1, wherein the core area of the cross-connector from which the four legs extend is also provided with break-throughs, or alternatively, recesses.

3. Cross-connector according to claim 2, wherein each of the four legs are provided with six break-throughs, or alternatively recesses, which are arranged in pairs adjacent to one another so that three of them are always located at both sides of the longitudinal axes of the legs.

4. Cross-connector according to claim 1, wherein the four legs are positioned in the same level and extend at their inner ends into the core area of the cross-connector through abutment elements on which the profiled bars of the window grill abut.

5. Cross-connector according to claim 1, characterized in that the bottoms of the recesses are defined by a reinforcing wall located in the level of the legs.

6. Cross-connector according to claim 2, characterized in that the bottoms of the recesses are defined by a reinforcing wall located in the level of the legs.

7. Cross-connector according to claim 3, characterized in that the bottoms of the recesses are defined by a reinforcing wall located in the level of the legs.

8. Cross-connector according to claim 6, wherein the reinforcing wall is located in the central level dividing the cross sectional thickness A of the cross-connector in two halves.

9. Cross-connector according to claim 1, wherein the legs are of the same lengths.

10. Cross-connector according to claim 1, wherein the legs are of the same size and configurations.

* * * * *

UNITED STATES PATENT AND TRADEMARK OFFICE

CERTIFICATE OF CORRECTION

PATENT NO. : 5,177,920

DATED : January 12, 1993

INVENTOR(S) : Karl Rafeld

It is certified that error appears in the above-identified patent and that said Letters Patent is hereby corrected as shown below:

In the Abstract:

Line 6, replace "they be" with --they can be--.

Col. 2, Line 8, replace "care area" with --core area--.

Signed and Sealed this

Second Day of November, 1998

*Attest:*

BRUCE LEHMAN

*Attesting Officer*

*Commissioner of Patents and Trademarks*